United States Patent [19]

Healey, Jr.

[11] 3,984,800

[45] Oct. 5, 1976

[54] ELECTRIC FUSE HAVING A CASING OF A SYNTHETIC-RESIN-GLASS-CLOTH LAMINATE INCLUDING ROVINGS

[75] Inventor: Daniel P. Healey, Jr., Merrimacport, Mass.

[73] Assignee: The Chase-Shawmut Company, Newburyport, Mass.

[22] Filed: June 11, 1975

[21] Appl. No.: 586,028

Related U.S. Application Data

[63] Continuation-in-part of Ser. No. 579,972, May 22, 1975.

[52] U.S. Cl. ..... 337/186; 337/414

[51] Int. Cl.[2] ..... H01H 85/02

[58] Field of Search ..... 337/158, 159, 186, 414

[56] References Cited

UNITED STATES PATENTS

| | | | |
|---|---|---|---|
| 2,866,875 | 12/1958 | Swain et al. | 337/158 X |
| 3,846,727 | 11/1974 | Harmon | 337/186 X |
| 3,911,385 | 10/1975 | Blewitt et al. | 337/186 X |

*Primary Examiner*—George Harris

*Attorney, Agent, or Firm*—Erwin Salzer

[57] ABSTRACT

An electric fuse has a casing of synthetic-resin-glass-cloth laminate which includes but three reinforcement plies, namely an outermost ply of woven glass fiber cloth forming an overlap extending in a direction longitudinally of said casing, and innermost ply formed by spaced rovings of glass fibers extending in a direction longitudinally of said casing, and an intermediate ply formed by a mat of substantially non-uniformly oriented glass fibers, said overlap of said outermost ply and said rovings penetrating into said intermediate ply to such an extent that the outer surface and the inner surface of said casing are substantially smooth substantially cylindrical coaxial surfaces.

4 Claims, 9 Drawing Figures

ELECTRIC FUSE HAVING A CASING OF A SYNTHETIC-RESIN-GLASS-CLOTH LAMINATE INCLUDING ROVINGS

BACKGROUND OF THE INVENTION

This is a continuation-in-part of my copending patent application filed May 22, 1975, Ser. No. 579,972 for ELECTRIC FUSE HAVING A MULTIPLY CASING OF SYNTHETIC RESIN-GLASS-CLOTH LAMINATE.

The above patent application solves primarily the problem of providing electric fuses having casings that have a high degree of dynamic bursting strength, which casings lend themselves to be manufactured cost-effectively by the pultrusion process. The casing of tube structure disclosed in the above referred-to parent application includes a minimum of three re-inforced plies of glass fibers, namely (1) an outermost ply of woven glass fiber fabric, (2) an innermost ply of woven glass fiber fabric, and (3) an intermediate ply formed by a mat of substantially non-uniformly oriented glass fibers, or an intermediate ply formed by a non-woven glass fiber fabric. At least the outermost ply and the innermost ply have an extent in excess of 360° and form overlaps. The three plies are integrated by a thermosetting resin into a tubular laminate having virtually uniform wall thickness along the entire periphery thereof. Woven glass fiber fabric is a relatively expensive material. Since the casing disclosed in my above patent application requires at least two re-inforcement plies of woven glass fiber fabric, its material cost are not minimized to the largest possible extent.

I have found that there are instances where the innermost reinforcement ply formed by woven glass fiber fabric may be dispensed with and a system of glass fiber rovings substituted for it, and yet a casing material or tubing material obtained that is entirely adequate for certain applications.

SUMMARY OF THE INVENTION

Fuses embodying this invention include a tubular casing of synthetic-resin-glass-cloth laminate housing the fusible element and the pulverulent arc-quenching filler, and supporting a pair of terminal elements for connecting the fusible element into an electric circuit. The aforementioned casing comprises but three re-inforcement plies. The outermost ply is of woven glass fiber cloth forming an overlap extending in a direction longitudinally of said casing, an innermost ply formed by spaced rovings of glass fibers extending in a direction longitudinally of said casing, and an intermediate ply formed by a mat of substantially non-uniformly oriented glass fibers, said overlap of said outermost ply and said rovings penetrating into said intermediate ply to such an extent that the outer surface and the inner surface of said casing are substantially smooth, substantially cylindrical coaxial surfaces.

DESCRIPTION OF PREFERRED EMBODIMENT

Figure 1:
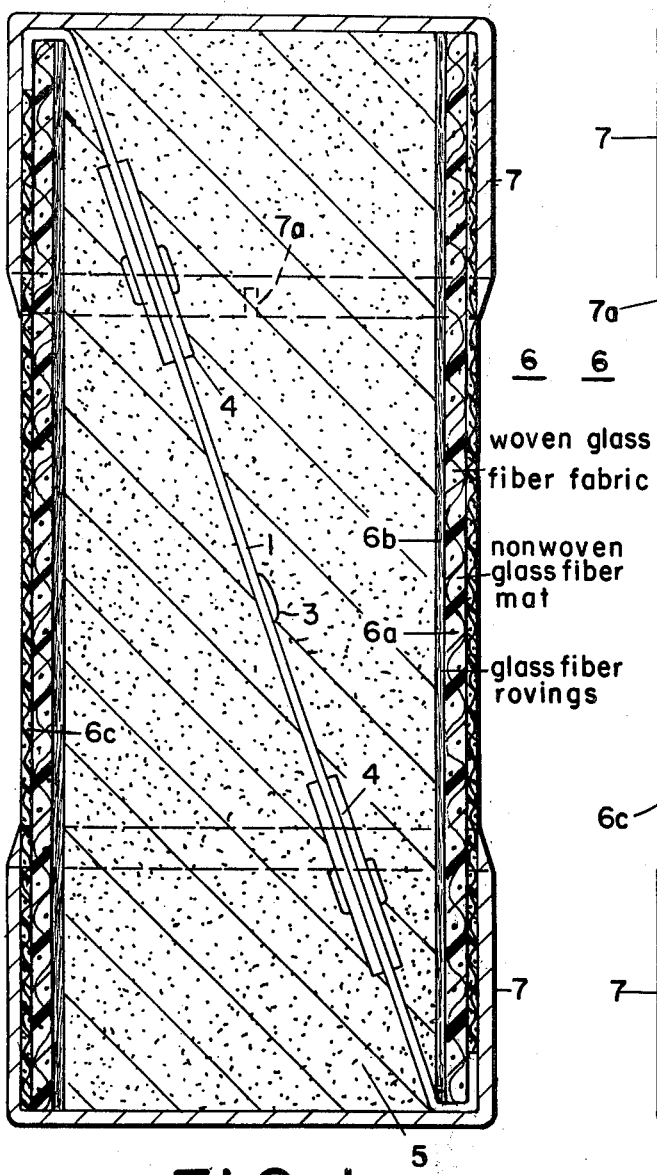
FIG. 1 is a substantially longitudinal section of a low voltage fuse embodying the present invention.
Figure 2:
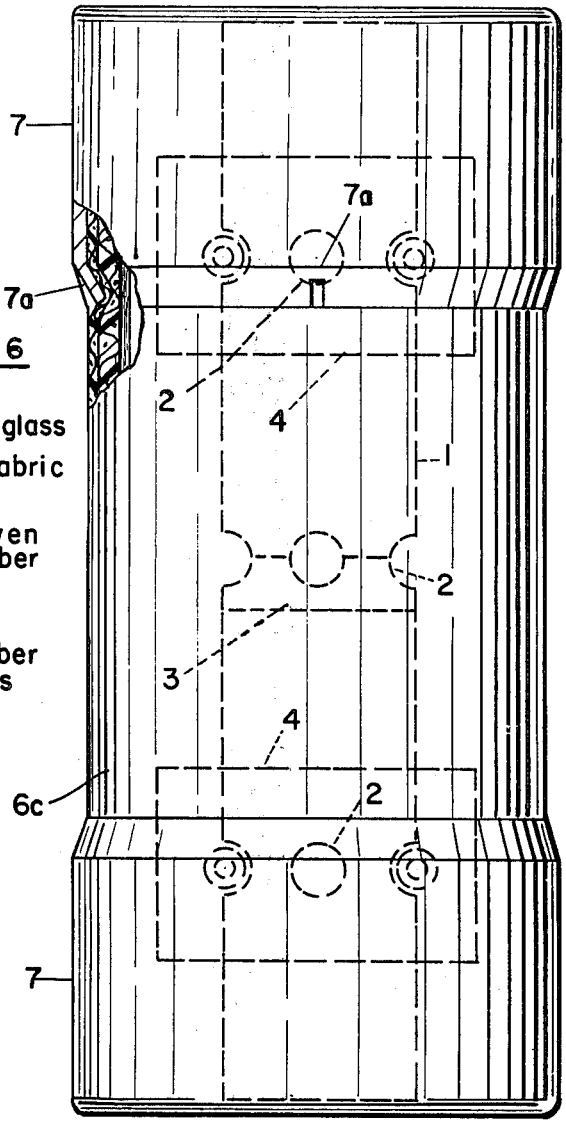
FIG. 2 is substantially a side elevation of the fuse structure of FIG. 1 showing a small portion thereof in section.

Referring to FIGS. 1 and 2, numeral 1 has been applied to indicate a fusible element in ribbon-form provided with perforations 2 forming three serially related areas of reduced cross-section. The central of these areas is provided with a low fusing point overlay 3, e.g. of tin, for severing fusible element 1 on occurrence of small overloads of excessive duration. The axially outer areas of reduced cross-section are sandwiched between arc-voltage control plates 4 described in detail in U.S. Pat. No. 2,964,604 to P. C. Jacobs et al, Dec. 13, 1960 for CURRENT-LIMITING FUSES HAVING COMPOUND ARC-VOLTAGE GENERATING MEANS. In FIG. 1 fusible element 1 and plates 4 are shown in elevation rather than in section. Fusible element 1 is surrounded by pulverulent or granular arc-quenching means, preferably a body 5 of quartz sand. Fusible element 1 and the body of arc-quenching filler are enclosed in a tubular casing of a novel synthetic-resin-glass-cloth laminate generally designated by numeral 6. Casing 6 supports on the ends thereof a pair of terminal elements 7, e.g. in form of caps, or ferrules. Instead of being formed by caps or ferrules, the fuse might be provided with terminal elements in form of plugs inserted into the ends of casing 6, and pinned to the latter by steel pins. The fusible element 1 is bent over the rims of casing 6 to the outer surface thereof, and caps 7 are mounted on the portions of fusible element 1 situated on the outside of casing 6. Thus caps or ferrules 7 are conductively interconnected by fusible element 1. To minimize the resistance of the current path from one cap 7 to the other, the ends of fusible element 1 are preferably soldered to caps 7 in a fashion and by means well known in the fuse art.

Figure 2A:
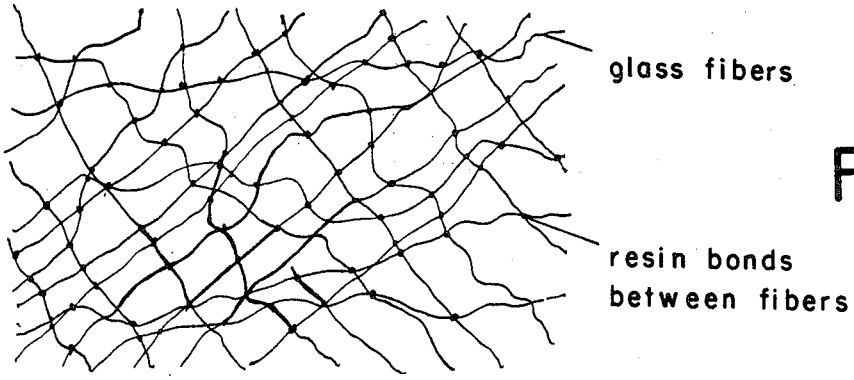
FIG. 2*a* is a view of a non-woven glass fiber mat forming part of the structure of FIGS. 1 and 2.

Casing 6 includes a first or intermediate ply 6*a* formed of a non-woven glass fiber mat material as shown in FIG. 2*a*, a second radially inner ply 6*b* of spaced glass fiber rovings and a third radially outer ply 6*c* of woven glass fiber fabric. The intermediate ply 6*a* is sandwiched between plies 6*b*, 6*c*. Casing 6 further includes a thermosetting resin integrating plies 6*a*, 6*b*, 6*c* into a tubular laminate.

Figure 3:
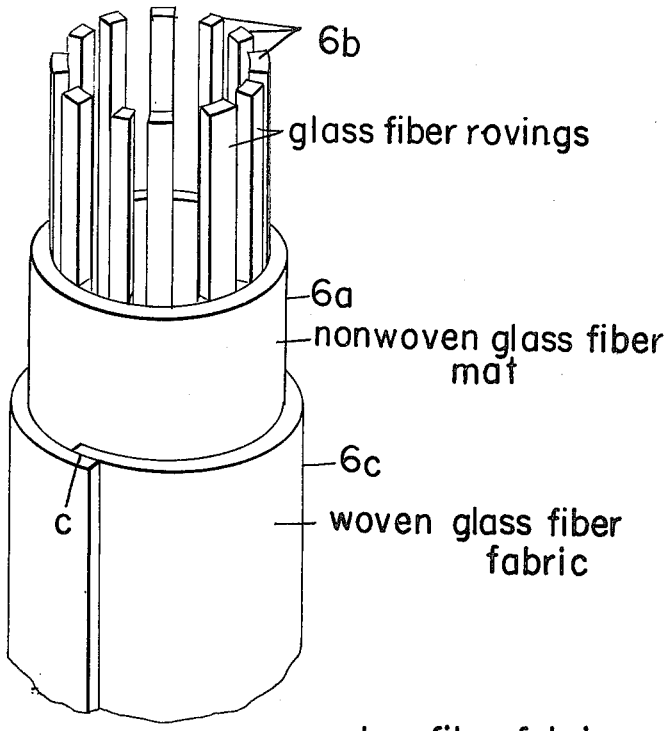
FIG. 3 is an isometric diagrammatic representation of the constituent re-inforcement inserts of the casing structure of FIGS. 1 and 2.

The configuration of the glass fiber reinforcement inserts forming plies 6*a*, 6*b* and 6*c* are shown diagrammatically in FIG. 3.

FIG. 3 shows separately the insert-forming outer ply 6*c* of woven fiber glass fabric. The insert or ply 6*c* has a circumferential extent in excess of 360°. Ply 6*c* forms an overlapping area *c* where two layers of the insert or ply 6*c* are superimposed.

As diagrammatically shown in FIG. 3 the ply 6*a* of a non-woven glass fiber fabric or a glass fiber mat made up of non-uniformly oriented fibers has a circumferential extent of 360° and thus does not form an overlap. Ply 6*a* may, however, form an overlapping area where to layers of ply 6*a* are superimposed. Such an overlapping area of ply 6a should be angularly displaced about 180° relative to the area *c* shown in FIG. 3.

Figure 5:
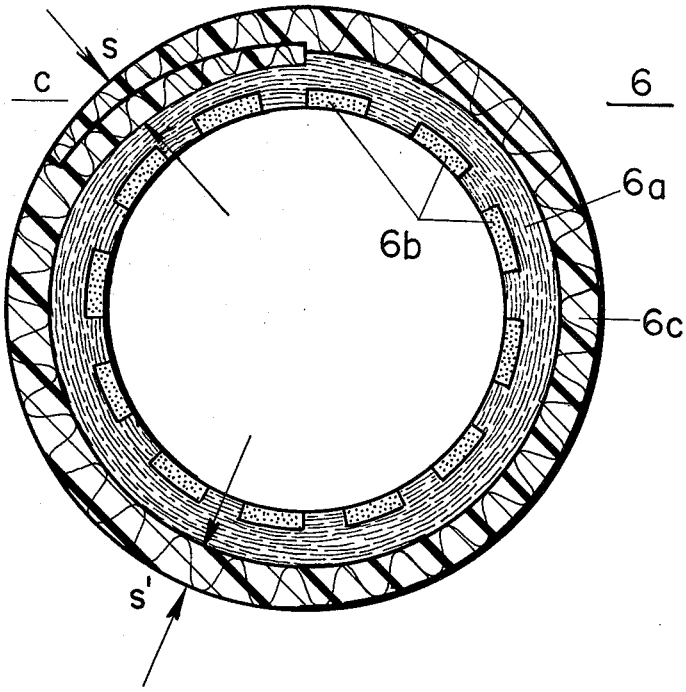
FIG. 5 shows as such in cross-section the casing of the structure of FIGS. 1 and 2.

As diagrammatically shown in FIG. 3, the radially inner ply 6b of glass fiber rovings has a circumferential extent of 360°. The constituent rovings of ply 6b form a squirrel-cage-like structure which is compressed into the intermediate relatively flexible ply 6a. As a result, the inner surface of casing 6 is in the form of a substantially smooth cylindrical surface as clearly shown in FIG. 5. The same applies also to the outer surface of casing 6. It is apparent from FIG. 5 that due to the pressure exerted by the pultrusion machinery, or pultrusion die, the ply 6b of rovings is pressed into the ply 6a of mat material and that due to the pressure exerted by the pultrusion machinery, or pultrusion die, the thickness *s* of ply 6c at the region of overlap *c* is less than the thickness $2s'$ ($s < 2s'$), $s'$ being the thickness of ply 6c remote from overlap *c*. FIG. 5 further shows clearly that overlap *c* is pressed by the action of the pultrusion machinery into ply 6a so that the thickness of ply 6a is less in the region of overlap *c* than at any point remote from that region. The ratio of glass-to-synthetic resin in the region of overlap *c* by far exceeds the ratio of glass-to-synthetic resin remote from overlap *c*, i.e. at any other region of casing 6. The constituent glass fiber rovings of ply 6b have two functions. One of their functions consists in drawing the radially outer plies 6a, 6c through the pultrusion die, and the other function is to increase the mechanical strength provided by the radially outer plies 6a, 6c.

Figure 4A:
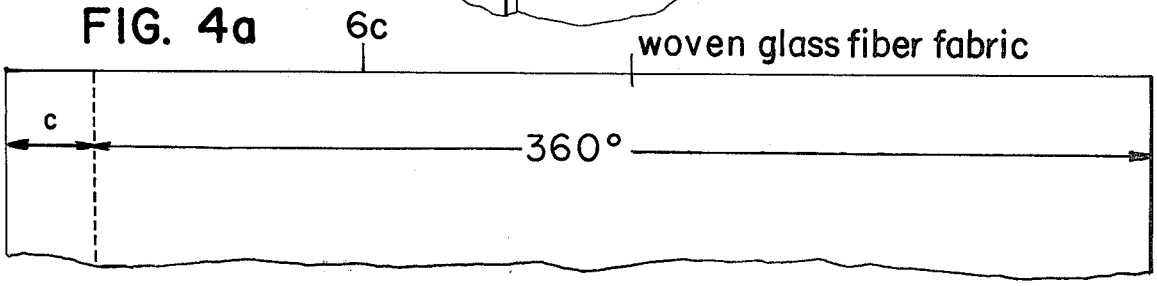
FIGS. 4*a*–4*c* show separately the constituent re-inforcement inserts of the casing structure of FIGS. 1 and 2 developed into the plane of the drawing paper.
Figure 4B:
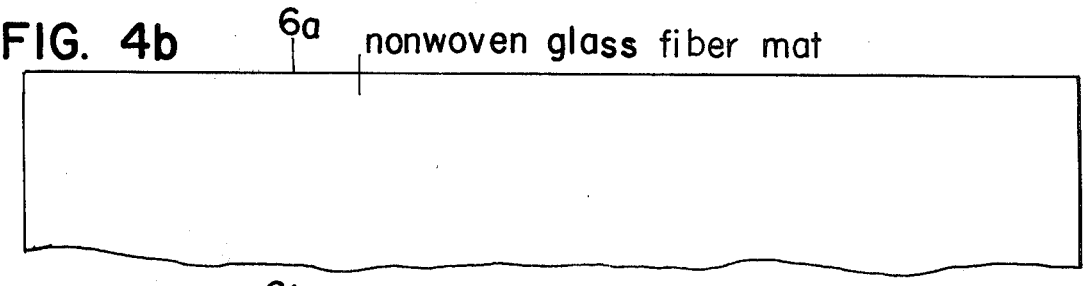

FIG. 4b has been drawn on the assumption that the intermediate ply 6a does not form an overlap such as the overlap *c* of ply 6c. As mentioned above, the intermediate ply 6a may be provided with an overlap region and the presence of such a region contributes to the mechanical strength of casing 6. Ply 6a may also be formed of several superimposed layers or webs of mat or non-woven glass fiber fabric, each forming an overlap and the several overlaps of intermediate ply 6a being angularly displaced.

Figure 4C:
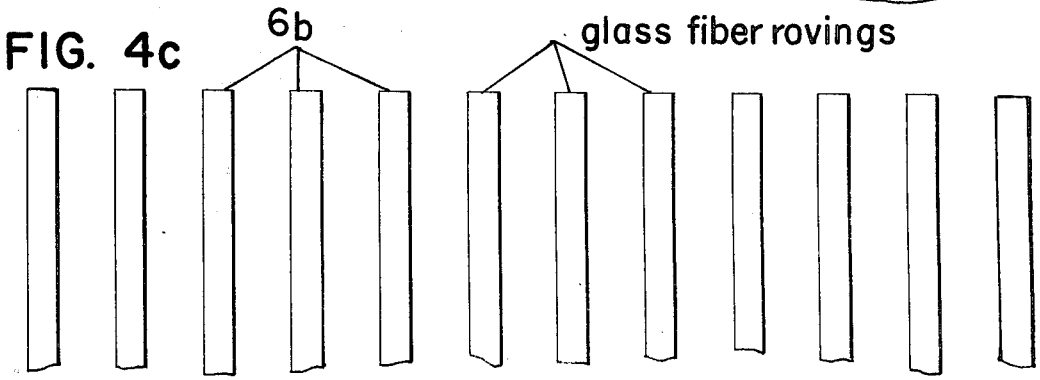
Figure 6:
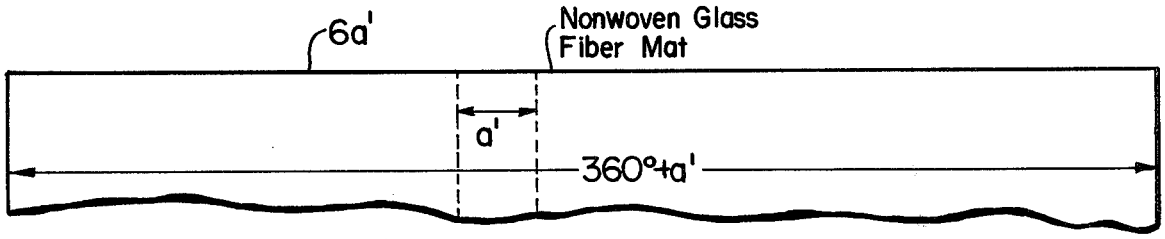
FIG. 6 shows a modification of the non-woven glass fiber mat of FIG. 4*b* which may take the place thereof.

FIG. 6 shows a ply of non-woven glass fiber mat 6a' which may take the place of ply 6a shown in FIG. 4b and be combined with plies 6c and 6b shown in FIGS. 4a and 4c, respectively. The intermediate ply 6a shown in FIG. 6 has an extent in excess of 360° and forms an overlap *a'* extending in a direction longitudinally of casing 6 shown in FIGS. 1 and 2. Overlap *a'* of intermediate ply 6a' is angularly displaced relative to overlap *c* of the outermost ply 6c (see FIG. 4a) of woven glass fiber fabric.

As mentioned above the three plies 6a, 6b, 6c are integrated into a tubular laminate by means of an appropriate thermosetting resin. The wall thickness of casing 6 is substantially uniform or equal along its perimeter of 360°.

The tubing or casing material which has been described above is not limited to use in connection with electric fuses, but may be applied wherever like requirements obtain.

I claim as my invention:

1. In an electric fuse the combination of a. a fusible element;

b. a body of pulverulent arc-quenching filler embedding said fusible element;

c. a pair of terminal elements each arranged adjacent one of the ends of said fusible element for connecting said fusible element into an electric circuit; and d. a tubular casing of synthetic-resin-glass-cloth laminate housing said fusible element and said filler and supporting said pair of terminal elements, said casing having but three fibrous re-inforcement plies including an outermost ply of woven glass fiber cloth forming an overlap extending in a direction longitudinally of said casing, an innermost ply formed by spaced rovings of glass fibers extending in a direction longitudinally of said casing, and an intermediate ply formed by a mat of substantially non-uniformly oriented glass fibers, said overlap of said outermost ply and said rovings penetrating into said intermediate ply to such an extent that the outer surface and the inner surface of said casing are substantially smooth substantially cylindrical coaxial surfaces.

2. An electric fuse including a. a fusible element;

b. arc-quenching means surrounding said fusible element;

c. a casing housing said fusible element and said arc-quenching means;

d. a pair of terminal elements arranged on the ends of, and supported by, said casing conductively interconnected by said fusible element;

e. said casing including an outermost ply of woven glass fiber fabric, an intermediate ply of glass fiber mat material having non-uniformly oriented fibers, and an innermost ply of spaced glass fiber rovings arranged parallel to the axis of said casing and forming a squirrel-cage-like structure, said outermost ply having an extent in excess of 360° and forming an overlap extending in a direction longitudinally of said casing;

f. said casing further including a thermosetting resin integrating said outermost ply, said intermediate ply and said innermost ply into a laminate; and g. the glass fiber density of said laminate being locally increased at the region of said overlap of said outermost ply to such an extent and said glass fiber rovings being compressed into said glass fiber mat material to such an extent that the wall thickness of said casing is substantially uniform along the entire periphery thereof.

3. An electric fuse as specified in claim 2 wherein said intermediate ply has an extent in excess of 360° and forms an overlap extending in a direction longitudinally of said casing, said overlap of said intermediate ply being angularly displaced relative to said overlap of said outermost ply.

4. A synthetic-resin-glass cloth laminate tubing including an outermost re-inforcement ply of woven glass fiber cloth encompassing more than 360° and forming an overlap extending in a direction longitudinally of said tubing, an innermost ply formed by a squirrel-cage-like arrangement of spaced rovings of glass fibers and an intermediate ply formed by a mat of substantially non-uiformly oriented glass fibers, said overlap of said outermost ply and said rovings penetrating into said intermediate ply to such an extent that the outer surface and the inner surface of said tubing are substantially smooth substantially cylindrical coaxial surfaces.

* * * * *